US008076863B2

(12) United States Patent
Chao et al.

(10) Patent No.: US 8,076,863 B2
(45) Date of Patent: Dec. 13, 2011

(54) BACK LIGHT MODULE

(75) Inventors: Han-Yu Chao, Taipei County (TW); Chien-Lung Tsou, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 688 days.

(21) Appl. No.: 12/177,887

(22) Filed: Jul. 23, 2008

(65) Prior Publication Data

US 2009/0256495 A1 Oct. 15, 2009

(30) Foreign Application Priority Data

Apr. 11, 2008 (TW) ..... 97113246 A

(51) Int. Cl.
*H05B 41/16* (2006.01)
*G09G 3/10* (2006.01)

(52) U.S. Cl. ..... 315/246; 315/169.3

(58) Field of Classification Search ..... 315/169.1, 315/169.2, 169.3, 160–162, 299, 300, 302, 315/307–308, 312; 345/56, 79–77, 91
See application file for complete search history.

(56) References Cited

U.S. PATENT DOCUMENTS

| | | | | |
|---|---|---|---|---|
| 5,751,263 | A | 5/1998 | Huang et al. | |
| 6,545,652 | B1 | 4/2003 | Tsuji | |
| 6,914,390 | B2 * | 7/2005 | Koyama | 315/169.3 |
| 7,511,695 | B2 * | 3/2009 | Furukawa et al. | 345/102 |
| 7,619,598 | B2 * | 11/2009 | Pulvirenti et al. | 345/82 |
| 2007/0247399 | A1 * | 10/2007 | Yamashita et al. | 345/82 |
| 2009/0153075 | A1 * | 6/2009 | Li et al. | 315/294 |

FOREIGN PATENT DOCUMENTS

| | | |
|---|---|---|
| TW | M253031 | 12/2004 |
| TW | 200629967 | 8/2006 |

* cited by examiner

*Primary Examiner* — Douglas W Owens
*Assistant Examiner* — Minh D A
(74) *Attorney, Agent, or Firm* — Jianq Chyun IP Office

(57) ABSTRACT

A back light module is provided. The back light module includes a plurality of light source matrixes, a current adjusting circuit and a light source driving circuit, wherein each of the light source matrixes includes N light emitting units and N is an integer greater than 1. First ends of the light emitting units are electrically connected to each other, and a second end of the $i^{th}$ light emitting unit is electrically connected to an $i^{th}$ level switch line, wherein i is an integer and $1 \leqq i \leqq N$. The current adjusting circuit supplies and controls the current of each of the light source matrixes through level switch lines. The light source driving circuit drives the light source matrixes sequentially.

13 Claims, 6 Drawing Sheets

BACK LIGHT MODULE

CROSS-REFERENCE TO RELATED APPLICATION

This application claims the priority benefit of Taiwan application serial no. 97113246, filed on Apr. 11, 2008.The entirety of the above-mentioned patent application is hereby incorporated by reference herein and made a part of specification.

BACKGROUND OF THE INVENTION

1.Field of the Invention

The present invention relates to a light source module, and more particularly to a back light module.

2.Description of Related Art

In recent years, back light modules in liquid crystal displays (LCD) mostly adopt light emitting diodes (LED's) that have features such as long life, high efficiency, and low pollution to the environment. Brightness of LED's relates to display quality of an LCD. Therefore, today's manufacturing technology emphasizes on the design of back light modules.

FIG. 1 is a circuit block diagram of a conventional back light module. Referring to FIG. 1, a conventional back light module 100 uses an output voltage $V_{out}$ generated by a voltage converter 110 to drive an LED matrix 120, which comprises a plurality of sets of LED series. A current adjusting circuit 130 is used to provide a current that flows through the LED matrix 120. In addition, the current adjusting circuit 130 controls turn-on status of its internal switches $SW_{11}$~$SW_{14}$ so as to change an average current of each set of the LED series provided by current sources 131~134 at a predetermined time. Accordingly, the current adjusting circuit 130 may adjust a brightness level of a light source generated by the LED matrix 120 by controlling the switches $SW_{11}$~$SW_{14}$.

In another aspect, the voltage converter 110, the LED matrix 120, and a feedback compensation circuit 140 comprise a closed loop. An error amplifier 141 compares feedback voltages $V_{fb1}$~$V_{fb4}$ generated by each set of the LED series with a reference voltage $V_{ref}$, and a voltage controller 142 generates a control signal $S_{ct}$ according to the comparison result from the error amplifier 141. Accordingly, the voltage converter 110 adjusts a level the output voltage $V_{out}$ based on the control signal $S_{ct}$.

However, in practical applications, in the conventional back light module 100, the current of each set of the LED series is controlled by a switch and a current source so when contrast of a display image in an area control is raised, the number of the switches and the current sources in the current adjusting circuit 130 of the conventional back light module 100 must be increased in response. In this case, the conventional back light module 100 requires tremendous power consumption. As a result, temperature of internal circuits is increased and lifetime is decreased.

SUMMARY OF THE INVENTION

The present invention provides a back light module which uses a plurality of light source matrixes utilizing a same current adjusting circuit to lower power consumption of its own circuit.

The present invention provides a back light module that may correspondingly raise contrast of a display image with no need to increase the number of switches and current sources in a current adjusting circuit.

The present invention provides a back light module comprising a plurality of light source matrixes, a current adjusting circuit, and a light source driving circuit. Each of the light source matrixes comprises N light emitting units, where N is an integer greater than 1.First ends of the light emitting units are electrically connected to each other and a second end of the $i^{th}$ light emitting unit is electrically connected to an $i^{th}$ level switch line, where i is an integer and $1 \leqq i \leqq N$. In other words, the aforesaid light source matrixes are electrically connected to the N level switch lines.

In another aspect, the current adjusting circuit provides and controls a current that flows through each of the light source matrixes through the aforesaid level switch lines. The light source driving circuit is used to sequentially drive the aforesaid light source matrixes. The light source matrixes use the same current adjusting circuit through the N level switch lines so the power consumption of the back light module may be significantly decreased and thus its lifetime may be increased.

In one embodiment of the present invention, the aforesaid light source driving circuit comprises a plurality of second switches and a level control circuit. First ends of the second switches are used to receive a predetermined voltage. The light source driving circuit sequentially drives the second switches in a frame period. The level control circuit is used to generate a predetermined voltage and to adjust a level of the predetermined voltage once in every dimming time so as to switch the level of the predetermined voltage to one of a plurality of specified levels.

The present invention provides another back light module comprising a light source driving circuit, a plurality of light source matrixes, and a current adjusting circuit. Each of the light source matrixes comprises N light emitting units, where N is an integer greater than 1.The light source driving circuit is used to sequentially generate a plurality of driving pulses. The light source matrixes are individually driven according to the driving pulses.

In addition, first ends of the light emitting units are used to receive one of the driving pulses, while a second end of the $i^{th}$ light emitting unit is electrically connected to an $i^{th}$ level switch line, where i is an integer and $1 \leqq i \leqq N$. The current adjusting circuit provides and controls a current that flows through each of the light source matrixes through the aforesaid level switch lines. It should be noted that the light source matrixes use the same current adjusting circuit through the N level switch lines so the power consumption of the back light module may be significantly decreased and thus its lifetime may be increased.

In one embodiment of the present invention, the aforesaid light source driving circuit comprises a plurality of second switches and a level control circuit. First ends of the second switches are used to receive a predetermined voltage. The light source driving circuit is used to sequentially drive the second switches in a frame period such that second ends of the second switches sequentially provide the driving pulses. In addition, the level control circuit is used to generate a predetermined voltage and to adjust a level of the predetermined voltage once in every dimming time so as to switch the level of the predetermined voltage to one of a plurality of specified levels.

In one embodiment of the light source driving circuit, the light emitting units respectively comprise an LED series. Furthermore, the light source driving circuit drives one of the second switches once in every scan period, wherein the dimming time is an integral multiple of the frame period or the scan period.

In the present invention, a plurality of light source matrixes use a same current adjusting circuit by means of sequentially driving a plurality of light source matrixes. Accordingly, when contrast of a display image under area control is raised, the number of switches and current sources in the current adjusting circuit of the back light module need not be increased in response.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
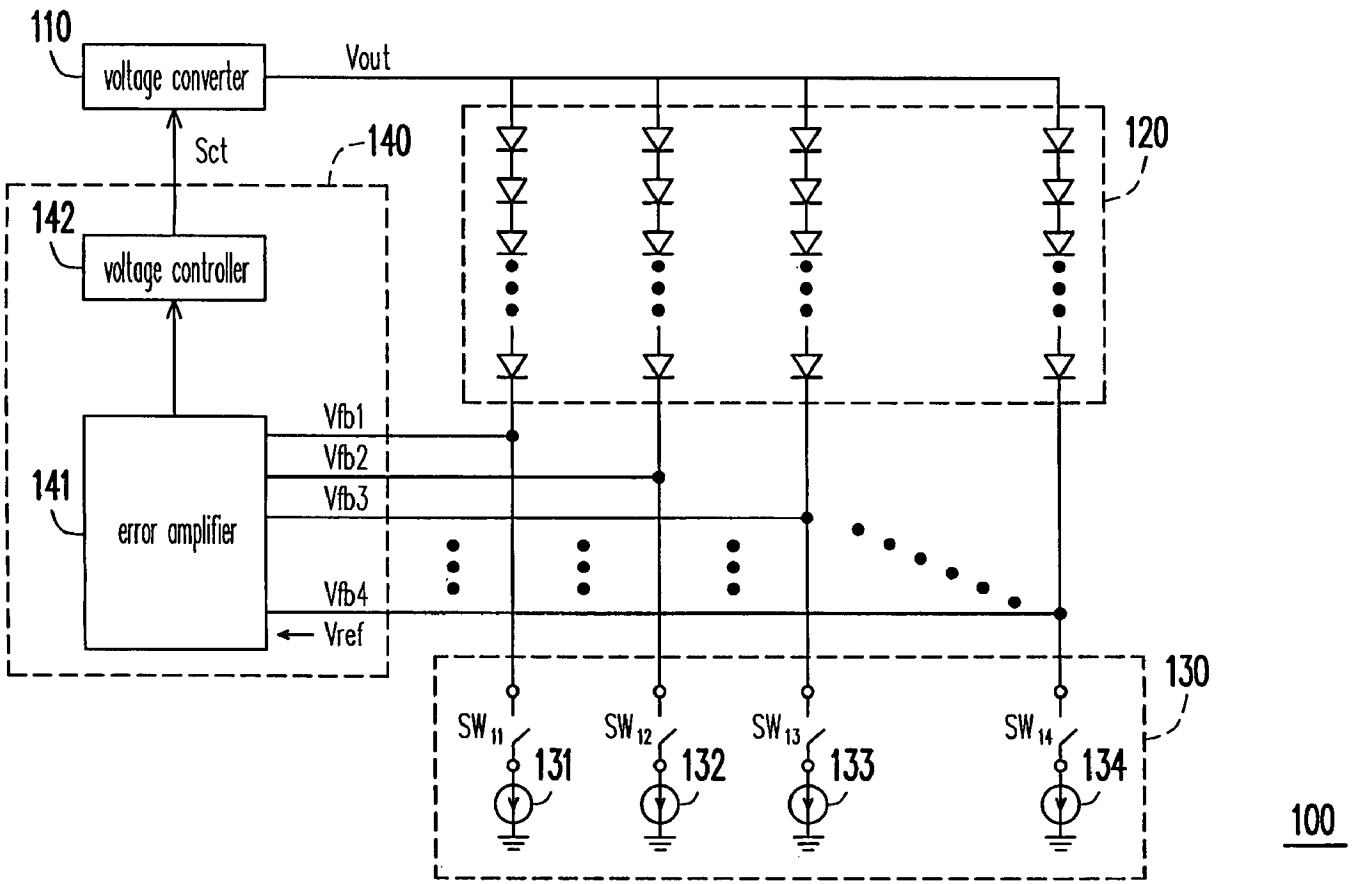
FIG. 1 (PRIOR ART)
FIG. 1 is a circuit block diagram of a conventional back light module.
Figure 2:
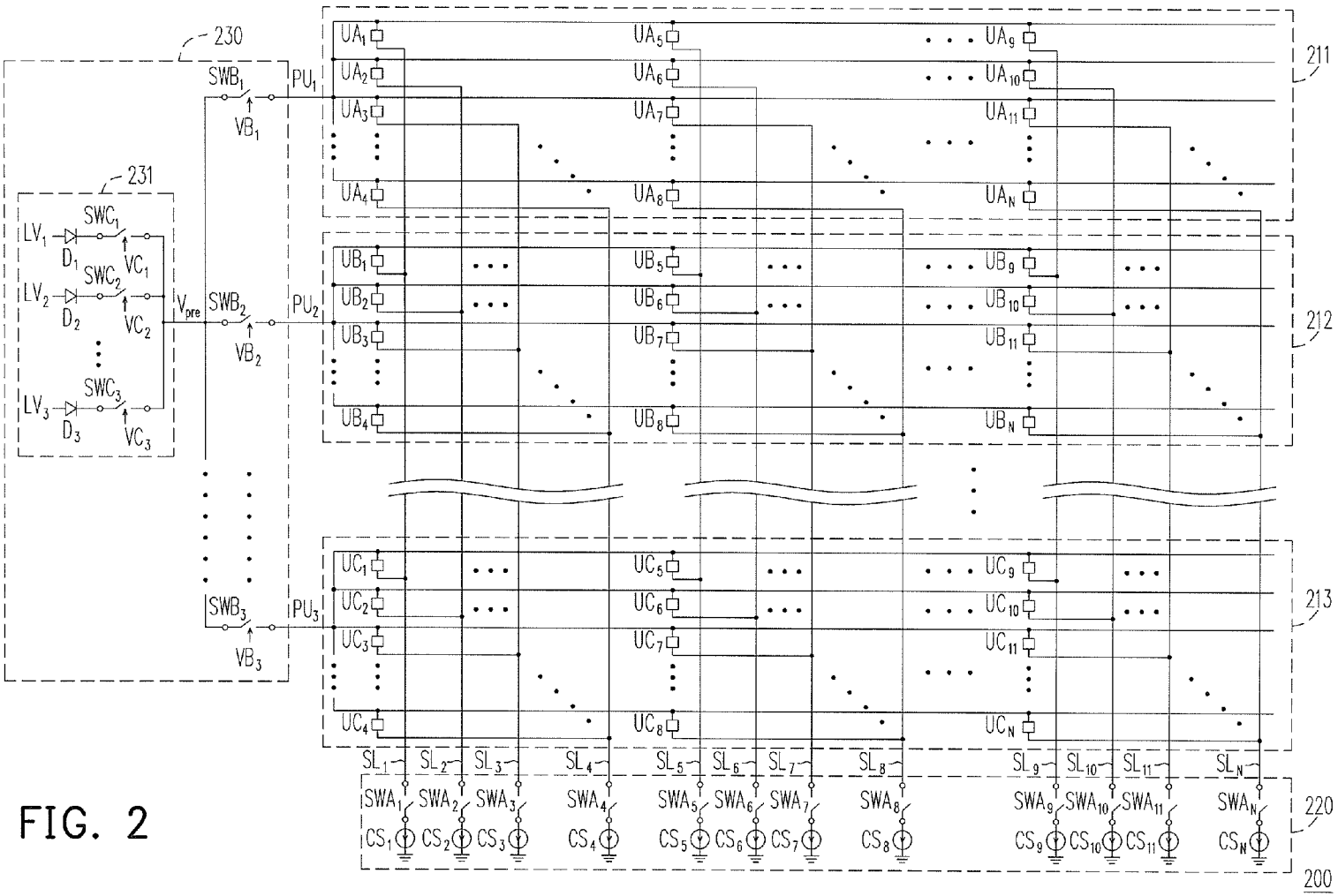
FIG. 2 is a circuit block diagram of a back light module according to an embodiment of the present invention.

FIG. 2 is a circuit block diagram of a back light module according to an embodiment of the present invention. Referring to FIG. 2, a back light module 200 comprises a plurality of light source matrixes 211~213, a current adjusting circuit 220, and a light source driving circuit 230. Each of the light source matrixes 211~213 comprises N light emitting units, where N is an integer greater than 1.For example, the light source matrix 211 comprises N light emitting units $UA_1$~$UA_N$, the light source matrix 212 comprises N light emitting units $UB_1$~$UB_N$, and the light source matrix 213 comprises N light emitting units $UC_1$~$UC_N$.

Looking at the internal structure of the light source matrix 211, first ends of the light emitting units $UA_1$~$UA_N$ are electrically connected to each other. In addition, a second end of the light emitting unit $UA_1$ is electrically connected to a level switch line $SL_1$, a second end of the light emitting unit $UA_2$ is electrically connected to a level switch line $SL_2$, a second end of the light emitting unit $UA_3$ is electrically connected to a level switch line $SL_3$, . . . , and a second end of the light emitting unit $UA_N$ is electrically connected to a level switch line $SL_N$. In other words, a second end of the $i^{th}$ light emitting unit $UA_i$ in the light source matrix 211 is electrically connected to the $i^{th}$ level switch line $SL_i$, where i is an integer and $1 \leqq i \leqq N$.

Similarly, looking at the internal structure of the light source matrix 212, first ends of the light emitting units $UB_1$~$UB_N$ are electrically connected to each other. In addition, a second end of the light emitting unit $UB_1$ is electrically connected to a level switch line $SL_1$, a second end of the light emitting unit $UB_2$ is electrically connected to a level switch line $SL_2$, a second end of the light emitting unit $UB_3$ is electrically connected to a level switch line $SL_3$, . . . , and a second end of the light emitting unit $UB_N$ is electrically connected to a level switch line $SL_N$. In other words, a second end of the $i^{th}$ light emitting unit $UB_i$ in the light source matrix 212 is electrically connected to the $i^{th}$ level switch line $SL_i$.

Furthermore, Referring to FIG. 2 and the internal structures of the light source matrixes 211 and 212, it can be deduced that a second end of the $i^{th}$ light emitting unit $UC_i$ in the light source matrix 213 is also electrically connected to the $i^{th}$ level switch line $SL_i$ and first ends of the light emitting units $UC_1$~$UC_N$ are electrically connected to each other. In other words, the light source matrixes 211~213 are electrically connected to the same N level switch lines $SL_1$~$SL_N$. In addition, the current adjusting circuit 220 is electrically connected to the level switch lines $SL_1$~$SL_N$. The light source driving circuit 230 is electrically connected to the first ends of the light emitting units in each of the light source matrixes 211~213. That is, the first ends of the light emitting units $UA_1$~$UA_N$, $UB_1$~$UB_N$, and $UC_1$~$UC_N$ are electrically connected to the light source driving circuit 230.

In an overall operation, the light source driving circuit 230 sequentially outputs a plurality of driving pulses $PU_1$~$PU_3$ respectively corresponding to the light source matrixes 211~213. The light source matrixes 211~213 are driven to generate light sources after receiving the corresponding driving pulses $PU_1$~$PU_3$. In other words, the light source driving circuit 230 sequentially drives the light source matrixes 211~213 such that the light source matrixes 211~213 sequentially generate light sources. Furthermore, the current adjusting circuit 220 provides and controls the current that flows through the light source matrixes 211~213 such that an average current of the light source matrixes 211~213 changes.

Figure 3:
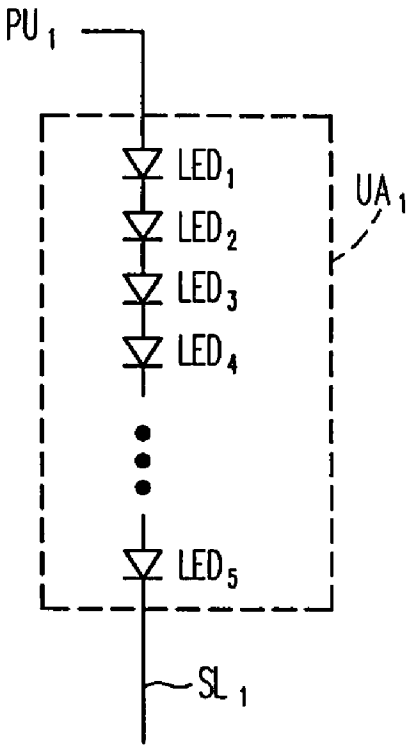
FIG. 3 is an internal structural view for illustrating a light emitting unit in the embodiment of FIG. 2.

It should be noted that, in the present embodiment, the light source driving circuit 230 adjusts a voltage level of the driving pulses $PU_1$~$PU_3$ to control the light sources generated by the light source matrixes 211~213. In other words, the back light module 200 achieves a dimming mechanism through the light source driving circuit 230 and/or the current adjusting circuit 220. In addition, the light emitting units $UA_1$~$UA_N$-$UB_1$~$UB_N$, and $UC_1$~$UC_N$ respectively comprise an LED series. For example, as shown in FIG. 3, the light emitting unit $UA_1$ comprises a plurality of LEDs, wherein LEDs $LED_1$~$LED_5$ are electrically connected in series to comprise an LED series.

In order for those skilled in the art to better understand the spirit of the present invention, the internal structures of the current adjusting circuit 220 and the light source driving circuit 230 are further illustrated below.

Referring to FIG. 2, the current adjusting circuit 220 comprises N switches $SWA_1$~$SWA_N$ and N current sources $CS_1$~$CS_N$. A first end of the switch $SWA_1$ is electrically connected to the level switch line $SL_1$ and a second end is electrically connected to a first end of the current source $CS_1$. Furthermore, a first end of the switch $SWA_2$ is electrically connected to the level switch line $SL_2$ and a second end is electrically connected to a first end of the current source $CS_2$. Accordingly, a first end of the switch $SWA_N$ is electrically connected to the level switch line $SL_N$ and a second end is electrically connected to a first end of the current source $CS_N$. In other words, a first end of the $i^{th}$ switch $SWA_i$ is electrically connected to the $i^{th}$ level switch line $SL_i$ and a second end is electrically connected to a first end of the $i^{th}$ current source $CS_i$. In addition, second ends of the current sources $CS_1$~$CS_N$ are connected to ground terminal.

In an overall operation, the current adjusting circuit 220 switches the turn-on status of the switches $SWA_1$~$SWA_N$ to change the current sources $CS_1$~$CS_N$ so as to provide an average current for each light emitting unit at a predetermined time. In other words, the current adjusting circuit 220 adjusts the average current of the light source matrixes 211~213 by controlling the switches $SWA_1$~$SWA_N$. Therefore, the back light module 200 achieves a dimming mechanism through the current adjusting circuit 220.

It should be noted that the light source matrixes 211~213 are all electrically connected to the level switch lines $SL_1$~$SL_N$. That is, the light source matrixes 211~213 share the use of the switches $SWA_1$~$SWA_N$ and the current sources $CS_1$~$CS_N$ in the current adjusting circuit 220. Accordingly, when contrast of a display image under area control is increased, the number of the switches and the current sources in the current adjusting circuit 220 of the back light module 200 need not be increased correspondingly. In other words, compared with the conventional technology, the present embodiment may more efficiently lower the power consumption of the back light module and thus promote circuit functionality and lifetime.

Continuously referring to FIG. 2, the light source driving circuit 230 comprises a plurality of switches $SWB_1$~$SWB_3$ and a level control circuit 231. The switches $SWB_1$~$SWB_3$ respectively correspond to the light source matrixes 211~213. First ends of the switches $SWB_1$~$SWB_3$ are used to receive a predetermined voltage $V_{pre}$. A second end of the switch $SWB_1$ is electrically connected to the first ends of the light emitting units $UA_1$~$UA_N$ in the corresponding light source matrix 211. A second end of the switch $SWB_2$ is electrically connected to the first ends of the light emitting units $UB_1$~$UB_N$ in the corresponding light source matrix 212. Similarly, a second end of the switch $SWB_3$ is electrically connected to the first ends of the light emitting units $UC_1$~$UC_N$ in the corresponding light source matrix 213.

In an overall operation, the light source driving circuit 230 sequentially turns on the switches $SWB_1$~$SWB_3$ to generate driving pulses $PU_1$~$PU_3$ during a frame period $T_F$. In another aspect, the level control circuit 231 is used to generate a predetermined voltage $V_{pre}$ and to adjust a level of the predetermined voltage $V_{pre}$ once in every dimming time $T_{41}$ so as to switch the level of the predetermined voltage $V_{pre}$ to one of a plurality of specified levels $LV_1$~$LV_3$. Accordingly, the voltage levels of the driving pulses $PU_1$~$PU_3$ vary with the change of the level of the predetermined voltage $V_{pre}$. In other words, the level control circuit 231 adjusts the average current of the light source matrixes 211~213 by controlling the level of the predetermined voltage $V_{pre}$. Therefore, the back light module 200 may also achieve a dimming mechanism through the light source driving circuit 230.

Furthermore, the level control circuit 231 comprises a plurality of diodes $D_1$~$D_3$ and a plurality of switches $SWC_1$~$SWC_3$. The diodes $D_1$~$D_3$ respectively correspond to the specified levels $LV_1$~$LV_3$. Anode terminals of the diodes $D_1$~$D_3$ are electrically connected to the corresponding specified levels. In addition, the switches $SWC_1$~$SWC_3$ also respectively correspond to the diodes $D_1$~$D_3$. First ends of the switches $SWC_1$~$SWC_3$ are electrically connected to cathode terminals of the corresponding diodes, while second ends of the switches $SWC_1$~$SWC_3$ are electrically connected to the first ends of the switches $SWB_1$~$SWB_3$.

Here, the diodes $D_1$~$D_3$ are used to limit the current direction formed during the turn-on of the switches $SWC_1$~$SWC_3$. In another aspect, the level control circuit 231 turns on one of the switches $SWC_1$~$SWC_3$ once in every dimming time $T_{41}$ such that the level of the predetermined voltage $V_{pre}$ changes once in every dimming time $T_{41}$. It should be noted that if the light source driving circuit 230 turns on one of the switches $SWB_1$~$SWB_3$ once in every scan period $T_{42}$ during a frame period $T_F$, those skilled in the art may set the dimming time $T_{41}$ to be an integral multiple of the frame period $T_F$ or the scan period $T_{42}$.

Figure 4:
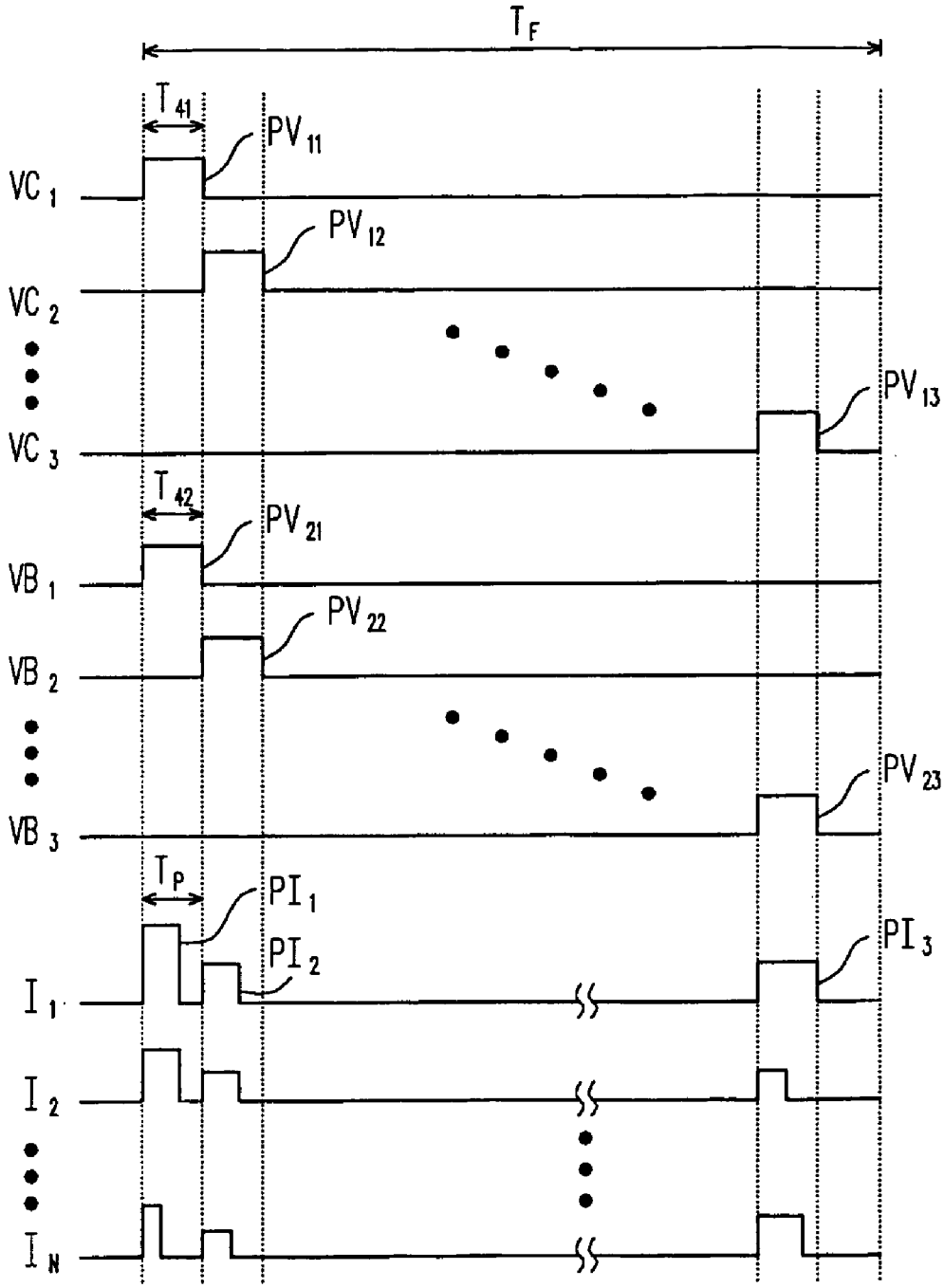
FIG. 4 is a timing waveform diagram for illustrating the embodiment of FIG. 2.

For example, FIG. 4 is a timing waveform diagram for illustrating the embodiment shown in FIG. 2, wherein $I_1$~$I_N$ represent the currents that flow through the level switch lines $SL_1$~$SL_N$, $VB_1$~$VB_3$ represent the control signals that are used to control the switches $SWB_1$~$SWB_3$, and $VC_1$~$VC_3$ represent the controls signals that are used to control the switches $SWC_1$~$SWC_3$. Here, the switch $SWC_1$ turns on two ends thereof according to a voltage pulse $PV_{11}$ in the control signal $VC_1$. The same operation mechanism can be applied for the switches $SWC_2$~$SWC_3$ and voltage pulses $PV_{12}$~$PV_{13}$. Correspondingly, the switch $SWB_1$ turns on two ends thereof according to a voltage pulse $PV_{21}$ in the control signal $VB_1$. The same operation mechanism can be applied for the switches $SWB_2$~$SWB_3$ and voltage pulses $PV_{22}$~$PV_{23}$.

In the embodiment shown in FIG. 4, the back light module 200 uses the light source driving circuit 230 and the current adjusting circuit 220 to achieve the dimming mechanism. The light source driving circuit 230 is used to adjust the current levels of the current pulses $PI_1$~$PI_3$ in the current $I_1$. The current adjusting circuit 220 is used to adjust the width of the current pulses $PI_1$~$PI_3$. It should be noted that because the dimming time $T_{41}$ is one time of the scan period $T_{42}$, every time when the light source driving circuit 230 switches the turn-on status of the switches $SWB_1$~$SWB_3$, the level control circuit 231 adjusts the level of the predetermined voltage $V_{pre}$ correspondingly.

In other words, the current levels of the current pulses $PI_1$~$PI_3$ change once in every dimming time $T_{41}$. In another aspect, the current adjusting circuit 220 controls the width of the current pulses $PI_1$~$PI_3$ in connection with the scan mechanism of the light source driving circuit 230 so as to make the duty cycle $T_p$ of the current $I_1$ equal to the scan period $T_{42}$. The operation mechanism of the light source driving circuit 230 and the current adjusting circuit 220 in relation to the currents $I_2$~$I_3$ can be deduced from the above illustration.

Figure 5:
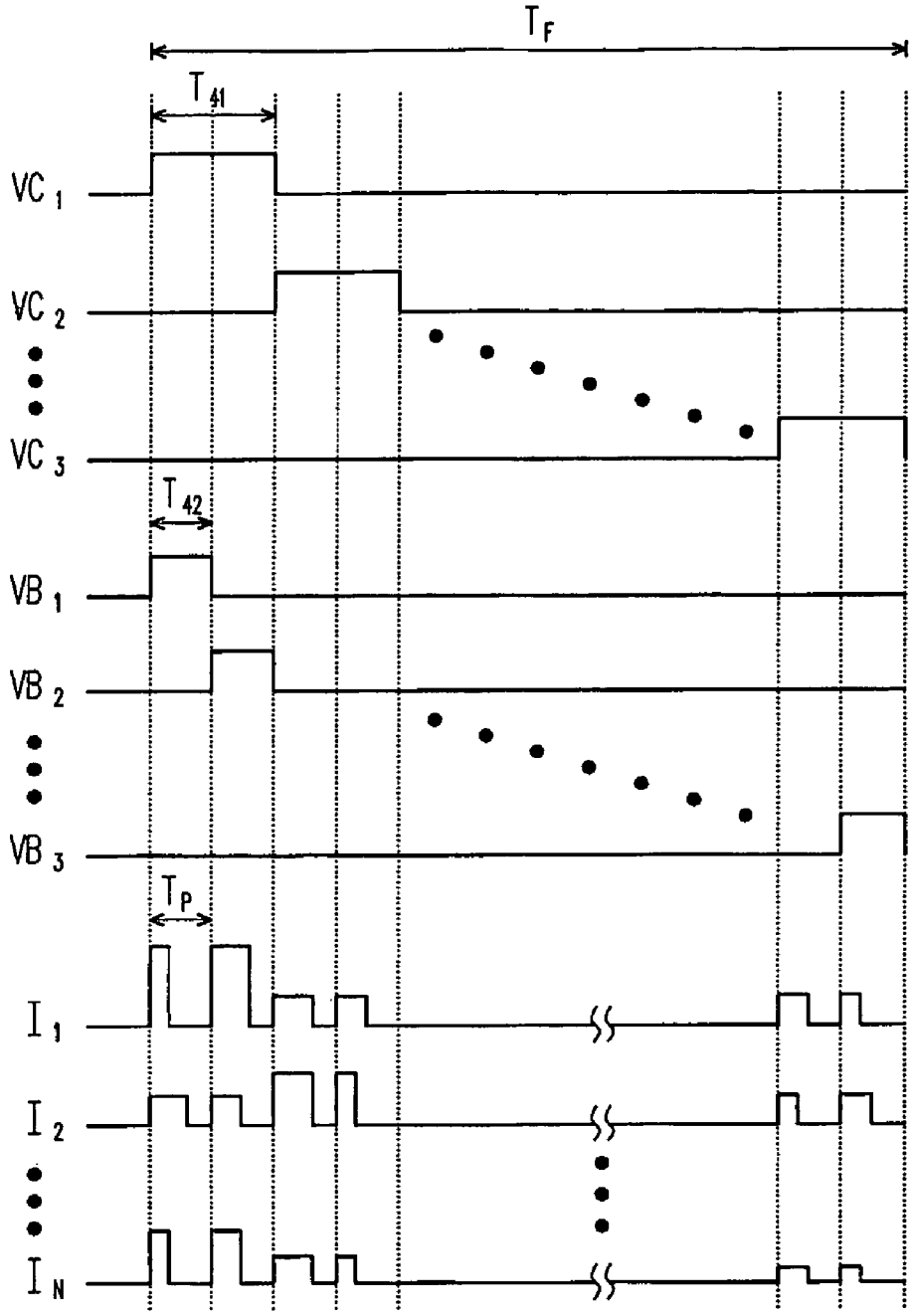
FIG. 5 is another timing waveform diagram for illustrating the embodiment of FIG. 2.
Figure 6:
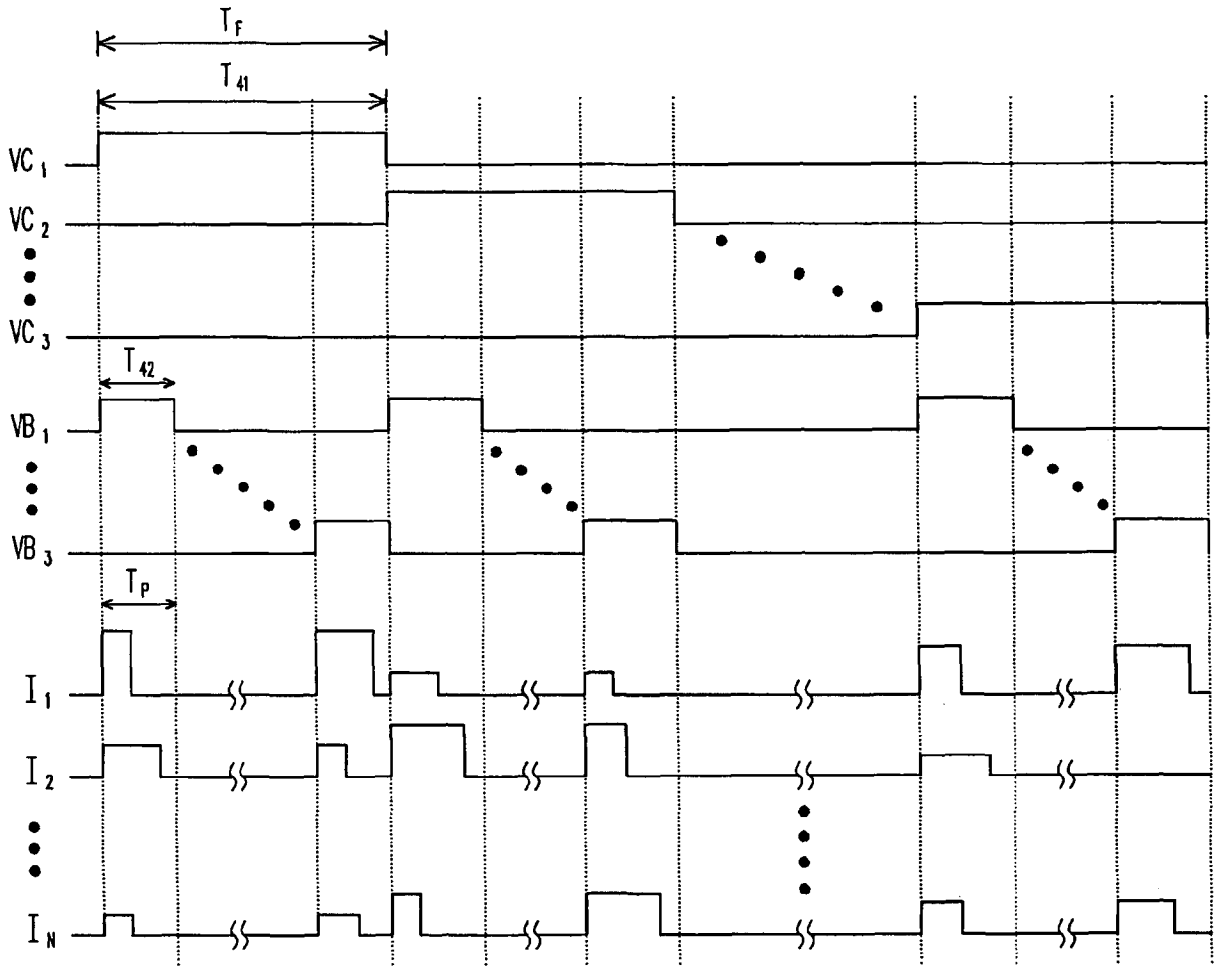
FIG. 6 is yet another timing waveform diagram for illustrating the embodiment of FIG. 2.

Furthermore, FIG. 5 and FIG. 6 are other timing waveform diagrams for illustrating the embodiment shown in FIG. 2. Similar to the embodiment shown in FIG. 4, in the embodiments shown in FIG. 5 and FIG. 6, the back light module 200 uses the light source driving circuit 230 and the current adjusting circuit 220 to achieve the dimming mechanism. However, what is different from the embodiment shown in FIG. 4 is that in the embodiment shown in FIG. 5, the dimming time $T_{41}$ is two times of the scan period $T_{42}$. That is, every time when the turn-on status of the switches $SWB_1$~$SWB_3$ are switched twice, the level control circuit 231 adjusts the level of the predetermined voltage $V_{pre}$ once correspondingly. Therefore, the current levels of the current pulses in the currents $I_1$~$I_3$ change once in every two times of the scan period $T_{42}$. However, under the control of the current adjusting circuit 220, the duty cycle $T_p$ of the currents $I_1$~$I_3$ is still the same as the scan period $T_{42}$.

In addition, in the embodiment shown in FIG. 6, the dimming time is one time of the frame period $T_F$. That is, every time when the switches $SWB_1$~$SWB_3$ are turned on sequentially, the level control circuit 231 adjusts the level of the predetermined voltage $V_{pre}$ once correspondingly. Therefore, the current levels of the current pulses in the currents $I_1$~$I_3$ change once in every frame period $T_F$. However, under the control of the current adjusting circuit 220, the duty cycle $T_p$ of the currents $I_1$~$I_3$ is still the same as the scan period $T_{42}$.

In summary, in the present invention, a plurality of light source matrixes use a same current adjusting circuit by means of sequentially driving a plurality of light source matrixes. Accordingly, when contrast of a display image under area control is raised, the number of the switches and the current sources in the current adjusting circuit of the back light module need not be increased in response. In other words, the present invention may effectively decrease the power consumption of the back light module and increase the circuit functionality and lifetime.

It will be apparent to those of ordinary skills in the technical field that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A backlight module, comprising:

a plurality of light source matrixes, wherein each of the light source matrixes is electrically connected to N level switch lines and comprises:

N light emitting units, wherein first ends of the light emitting units are electrically connected to each other and a second end of the $i^{th}$ light emitting unit is electrically connected an $i^{th}$ level switch line, N being an integer greater than 1, i being an integer and $1 \leqq i \leqq N$; and a current adjusting circuit, electrically connected to the level switch lines to provide and control the current that flows through the light source matrixes; and a light source driving circuit, electrically connected to the first ends of the light emitting units of each of the light source matrixes to sequentially drive the light source matrixes, wherein the light source driving circuit comprises:

a plurality of second switches, respectively corresponding to the light source matrixes, wherein first ends of the second switches receive a predetermined voltage, second ends of the second switches are electrically connected to the first ends of the light emitting units in the corresponding light source matrixes, and the light source driving circuit sequentially turns on the second switches in a frame period; and a level control circuit, for generating the predetermined voltage and adjusting a level of the predetermined voltage once in every dimming time so as to switch the level of the predetermined voltage to one of a plurality of specified levels.

2. The backlight module according to claim 1, wherein the current adjusting circuit comprises:

N first switches, wherein a first end of the $i^{th}$ first switch is electrically connected to the $i^{th}$ level switch line and the current adjusting circuit switches the turn-on status of the first switches to adjust an average current of the light source matrixes; and N current sources, wherein a first end of the $i^{th}$ current source is electrically connected to a second end of the $i^{th}$ first switch and second ends of the current sources are electrically connected to a ground terminal.

3. The back light module according to claim 1, wherein the level control circuit comprises:

a plurality of diodes, respectively corresponding to the specified levels, wherein anode terminals of the diodes are electrically connected to the corresponding specified levels; and a plurality of third switches, respectively corresponding to the diodes, wherein first ends of the third switches are electrically connected to cathode terminals of the corresponding diodes, second ends of the third switches are electrically connected to the first ends of the second switches, and the level control circuit turns on one of the third switches once in every dimming time.

4. The back light module according to claim 1, wherein the dimming time is an integral multiple of the frame period.

5. The back light module according to claim 1, wherein the light source driving circuit turns on one of the second switches once in every scan period and the dimming time is an integral multiple of the scan period.

6. The back light module according to claim 1, wherein the light emitting units respectively comprise a light emitting diode series.

7. A back light module, comprising:

a light source driving circuit, for sequentially generating a plurality of driving pulses, wherein the light source driving circuit comprises:

a plurality of second switches, wherein first ends of the second switches are use to receive a predetermined voltage, second ends of the second switches are used to provide the driving pulses, and the light source driving circuit sequentially turns on the second switches; and a level control circuit, for generating the predetermined voltage and adjusting a level of the predetermined voltage once in every dimming time so as to switch the level of the predetermined voltage to one of a plurality of specified levels;

a plurality of light source matrixes, electrically connected to the light source driving circuits and N level switch lines and respectively driven according to the driving pulses, wherein N is an integer greater than 1, and each of the light source matrixes comprises:

N light emitting units, wherein first ends of the light emitting units receive one of the driving pulses and a second end of the $i^{th}$ light emitting unit is electrically connected to the $i^{th}$ level switch line, i being an integer and $1 \leqq i \leqq N$; and a current adjusting circuit, electrically connected to the level switch lines to provide and to control a current that flows through the light source matrixes.

8. The backlight module according to claim 7, wherein the current adjusting circuit comprises:

N first switches, wherein a first end of the $i^{th}$ first switch is electrically connected to an $i^{th}$ level switch line and the current adjusting circuit switches the turn-on status of the first switches to adjust an average current of the light source matrixes; and N current sources, wherein a first end of the $i^{th}$ current source is electrically connected to a second end of the $i^{th}$ first switch and second ends of the current sources are electrically connected to the ground terminal.

9. The back light module according to claim 7, wherein the level control circuit comprises:

a plurality of diodes, respectively corresponding to the specified levels, wherein anode terminals of the diodes are electrically connected to the corresponding specified levels; and a plurality of third switches, respectively corresponding to the diodes, wherein first ends of the third switches are electrically connected to cathode terminals of the corresponding diodes, second ends of the third switches are electrically connected to the first ends of the second switches, and the level control circuit turns on one of the third switches once in every dimming time.

10. The back light module according to claim 7, wherein the dimming time is an integral multiple of the frame period.

11. The back light module according to claim 7, wherein the light source driving circuit turns on one of the second switches once in every scan period and the dimming time is an integral multiple of the scan period.

12. The back light module according to claim 7, wherein the light emitting units respectively comprise a light emitting diode series.

13. The back light module according to claim 7, wherein the light source driving circuit is further used to adjust the voltage level of the driving pulses to control a light source generated by the light source matrixes.

* * * * *